US007574761B2

(12) United States Patent
Davis

(10) Patent No.: US 7,574,761 B2
(45) **Date of Patent: *Aug. 18, 2009**

(54) INFLATABLE MATTRESS AND METHOD FOR POSITIONING A PATIENT

(75) Inventor: David T. Davis, Bethlehem, PA (US)

(73) Assignee: Woodlark Circle, Inc., Bethlehem, PA (US)

( * ) Notice: Subject to any disclaimer, the term of this patent is extended or adjusted under 35 U.S.C. 154(b) by 33 days.

This patent is subject to a terminal disclaimer.

(21) Appl. No.: 12/065,313

(22) PCT Filed: Sep. 28, 2006

(86) PCT No.: PCT/US2006/038035

§ 371 (c)(1),
(2), (4) Date: Feb. 29, 2008

(87) PCT Pub. No.: WO2007/055824

PCT Pub. Date: May 18, 2007

(65) Prior Publication Data

US 2008/0244830 A1 Oct. 9, 2008

(51) Int. Cl.
*A47C 27/10* (2006.01)
*A61G 7/10* (2006.01)

(52) U.S. Cl. ..... 5/710; 5/81.1 R

(58) Field of Classification Search ..... 5/81.1 HS, 5/81.1 R, 695, 619, 706, 710, 691, 711; 4/457
See application file for complete search history.

(56) References Cited

U.S. PATENT DOCUMENTS

| | | | | |
|---|---|---|---|---|
| 1,054,452 | A | 2/1913 | Sayen | |
| 1,981,666 | A | 11/1934 | Ridley | 5/632 |
| 3,129,438 | A | 4/1964 | Hall | 5/695 |
| 3,729,749 | A | 5/1973 | Rosecrans | 4/113 |
| 4,054,960 | A | 10/1977 | Pettit et al. | 5/357 |
| 4,207,633 | A | 6/1980 | Smith et al. | 5/90 |
| 4,272,856 | A | 6/1981 | Wegener et al. | 5/81 R |
| 4,517,690 | A | 5/1985 | Wegener | 5/81 R |
| 4,627,426 | A | 12/1986 | Wegener et al. | 128/132 R |
| 4,737,999 | A | 4/1988 | Halverson | 5/455 |
| 4,819,287 | A | 4/1989 | Halverson | 5/455 |
| 4,947,493 | A | 8/1990 | Salonica | 4/476 |
| 5,065,464 | A | 11/1991 | Blanchard et al. | 5/81 R |
| 5,067,189 | A | 11/1991 | Weedling et al. | 5/81 R |
| 5,081,721 | A | 1/1992 | Stefano | 5/90 |
| 5,185,897 | A | 2/1993 | Van Laanen | 5/455 |
| D335,999 | S | 6/1993 | Van Driessche | D6/604 |
| 5,483,709 | A | 1/1996 | Foster et al. | 5/81.1 |
| RE35,299 | E | 7/1996 | Weedling et al. | 5/81.1 T |
| 5,561,873 | A | 10/1996 | Weedling | 5/711 |
| 5,594,962 | A | 1/1997 | Bogdanoff | 5/422 |
| 5,598,593 | A | 2/1997 | Wolfe | 5/710 |
| 5,675,854 | A | 10/1997 | Zibelin | 5/695 |

(Continued)

*Primary Examiner*—Alexander Grosz
(74) *Attorney, Agent, or Firm*—Duane Morris LLP

(57) ABSTRACT

An inflatable mattress having an inflated torso support pad, a first leg extending out from a first portion of the inflated torso support pad, and a second leg spaced from the first leg and extending out from a second portion of the inflated torso support pad. The first leg and the second leg may be spread apart or deflated and rolled upon themselves so as to provide easy access to the patient during clinical procedures. A method is provided for positioning a patient with the inflatable mattress.

11 Claims, 17 Drawing Sheets

U.S. PATENT DOCUMENTS

| | | | | |
|---|---|---|---|---|
| 5,742,958 | A | 4/1998 | Solazzo | 5/81.1 R |
| 5,890,246 | A | 4/1999 | Davis | 5/735 |
| 6,000,078 | A | 12/1999 | Stefano | 5/695 |
| 6,073,291 | A | 6/2000 | Davis | 5/711 |
| 6,223,368 | B1 | 5/2001 | Anslin | 5/630 |
| 6,243,898 | B1 | 6/2001 | Ruff | 5/695 |
| 6,374,435 | B1 | 4/2002 | Leininger et al. | 5/81.1 HS |
| 6,415,583 | B1 | 7/2002 | Landi et al. | 54/65 |
| 6,418,579 | B2 | 7/2002 | Perez et al. | 5/713 |
| 6,677,026 | B1 | 1/2004 | Yates | 428/137 |
| 6,684,434 | B2 | 2/2004 | Ellis et al. | 5/713 |
| 6,687,935 | B2 | 2/2004 | Reeder et al. | 5/691 |
| 6,725,485 | B2 | 4/2004 | Hayes | 5/695 |
| 6,760,939 | B2 | 7/2004 | Ellis et al. | 5/713 |
| 6,820,938 | B2 | 11/2004 | Barrett | 297/452.41 |
| 6,857,143 | B2 | 2/2005 | McNulty | 5/81.1 C |
| 6,898,809 | B2 | 5/2005 | Davis | 5/81.1 R |
| 7,266,852 | B2 | 9/2007 | Davis | 5/81.1 HS |
| 2002/0166168 | A1 | 11/2002 | Weedling et al. | 5/81.1 R |
| 2003/0159212 | A1 | 8/2003 | Patrick et al. | 5/81.1 R |

INFLATABLE MATTRESS AND METHOD FOR POSITIONING A PATIENT

FIELD OF THE INVENTION

This is a national stage entry of PCT/US06/38035, filed on Sep. 28, 2006, the entirety of which is incorporated herein by reference.

BACKGROUND OF THE INVENTION

Immobility and prolonged confinement present both psychological and physically evident pathological problems to patients, ranging from malaise, depression, feelings of helplessness and loss of motivation on the one hand to decubitus ulcers, loss of local circulation and unsanitary dermatologic insult from waste products, or edema of extremities and gangrene on the other. Not only are patients affected by these conditions but so too are the caregivers and clinicians who must lift, turn, wash, change bedding and clothes, arrange for food, treat, and dispose of waste. Such operations often require that attendants have a high level of strength and skill to move and reposition the patient, regardless of the patient's size or weight.

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet. Examples of prior art transfer mattresses may be found in U.S. Pat. Nos. 4,054,960; 4,272,856; 4,517,690; 4,627,426; 5,065,464; 5,483,709; RE35,299; 5,561,873; 5,594,962; 5,598,593; 5,742,958; 6,073,291; 6,374,435; 6,415,583; 6,418,579; 6,677,026; 6,684,434; 6,687,935; 6,760,939; 6,857,143; 6,898,809, and published patent application No. 2002/0166168, which patents and applications are incorporated herein by reference.

There is a need in the art for an inflatable mattress that allows for easy toileting and treating the alimentary regions of patients without substantial need for moving the patient after completion for cleaning and the like.

SUMMARY OF THE INVENTION

The present invention provides an inflatable mattress having an inflated torso support pad, a first leg extending out from a first portion of the inflated torso support pad, and a second leg spaced from the first leg and extending out from a second portion of the inflated torso support pad. The first leg and the second leg define a gap between them to allow the legs to be spread apart for clinical treatment, toileting or cleaning of the patient, or deflated and rolled upon themselves so as to provide easy access to the patient during clinical procedures.

In one embodiment, an inflatable toileting mattress is provided including an inflated torso support pad having a torso inflation port, a first leg extending out from a portion of the inflated torso support pad and having a leg inflation port, and a second leg spaced from the first appendage and extending out from the portion of the inflated torso support pad. The first leg and the second leg define a gap between them and are arranged in flow communication with one another.

In another embodiment, an inflatable mattress is provided that includes an inflated torso support section having an end, a deflated first leg support section extending out from a portion of the end, and a deflated second leg support section spaced from the deflated first leg support section and extending out from the portion of the end. The deflated first leg support section and the deflated second leg support section define a gap between them so that each may be rolled upon itself toward the inflated torso support pad.

A method of positioning a patient for treatment is provided that includes the steps of positioning the patient upon an inflatable mattress that includes a deflated torso support section having an end, a deflated first leg support section extending out from a portion of the end, and a deflated second leg support section spaced from the deflated first leg support section and extending out from the portion of the end, wherein the deflated first leg support section and the deflated second leg support section define a gap between them. The torso support section is inflated along with the first leg support section and the second leg support section so as to fully support the patient on the mattress. The mattress and patient are then repositioned to a place where treatment may be provided to the patient. The first leg support and the second leg support are deflated, and each is rolled upon itself and toward the torso support section.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
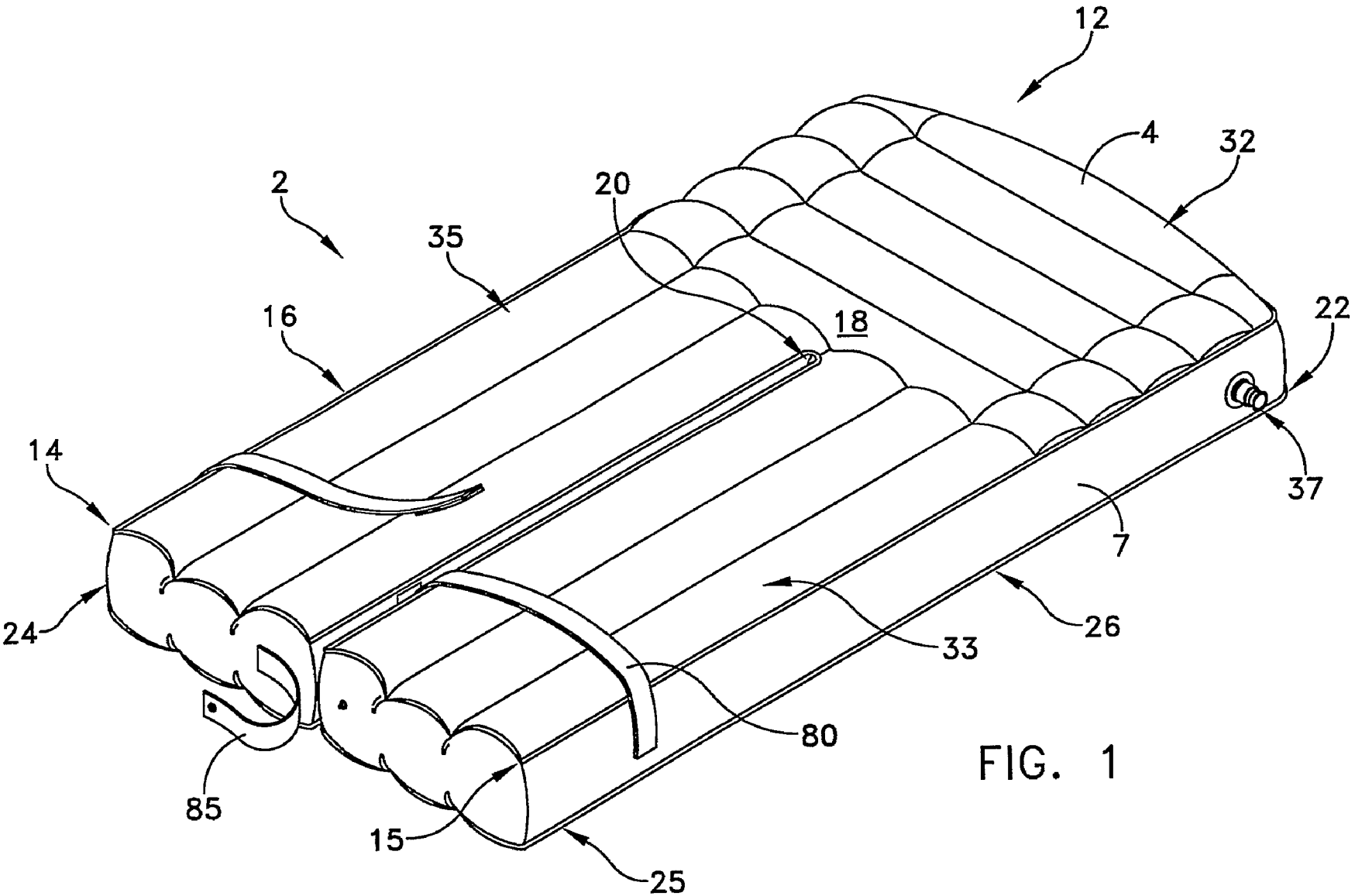
FIG. 1 is a perspective view of an inflatable mattress formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 2:
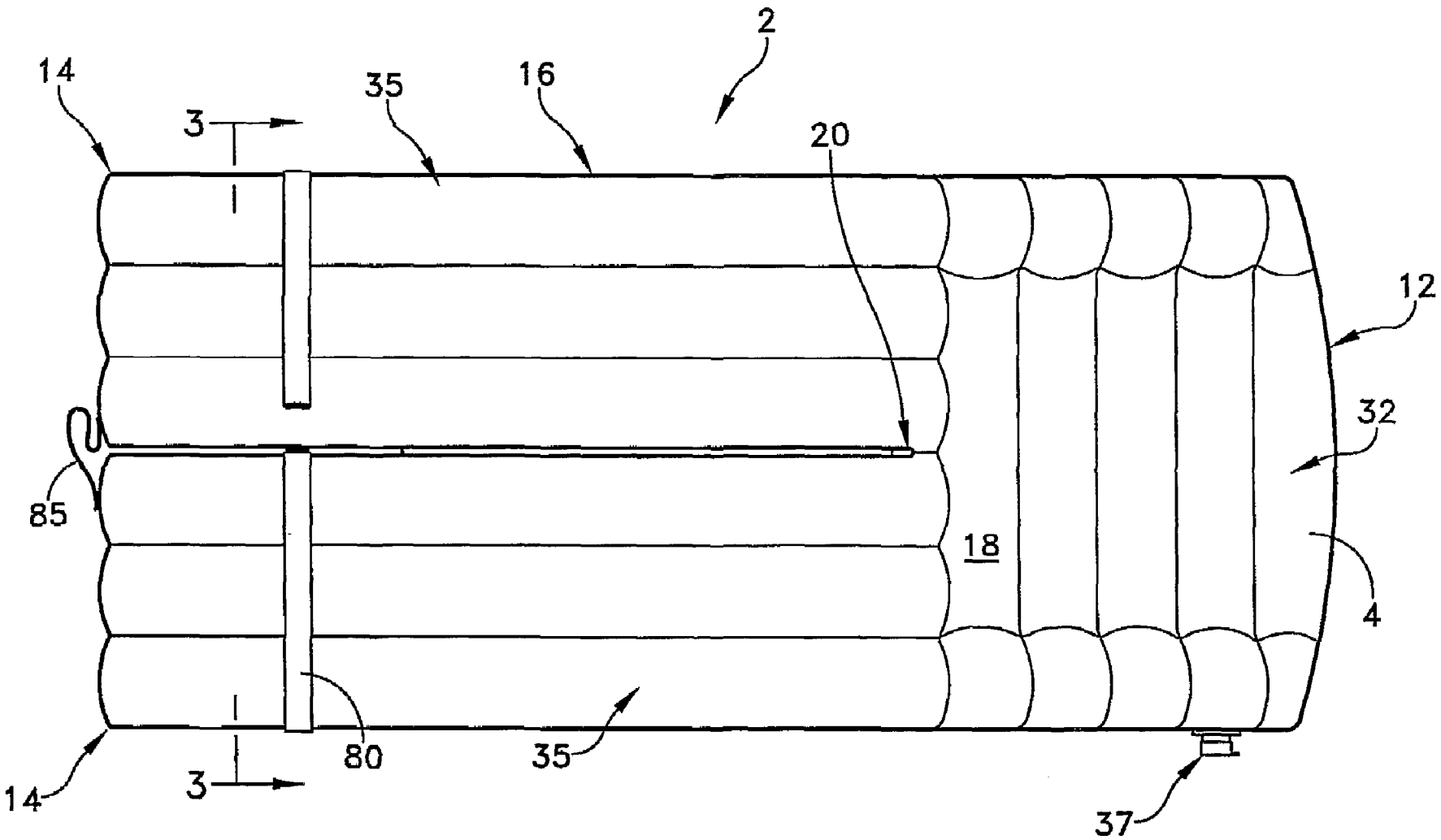
FIG. 2 is a top elevational view of the inflatable mattress shown in FIG. 1.
Figure 3:
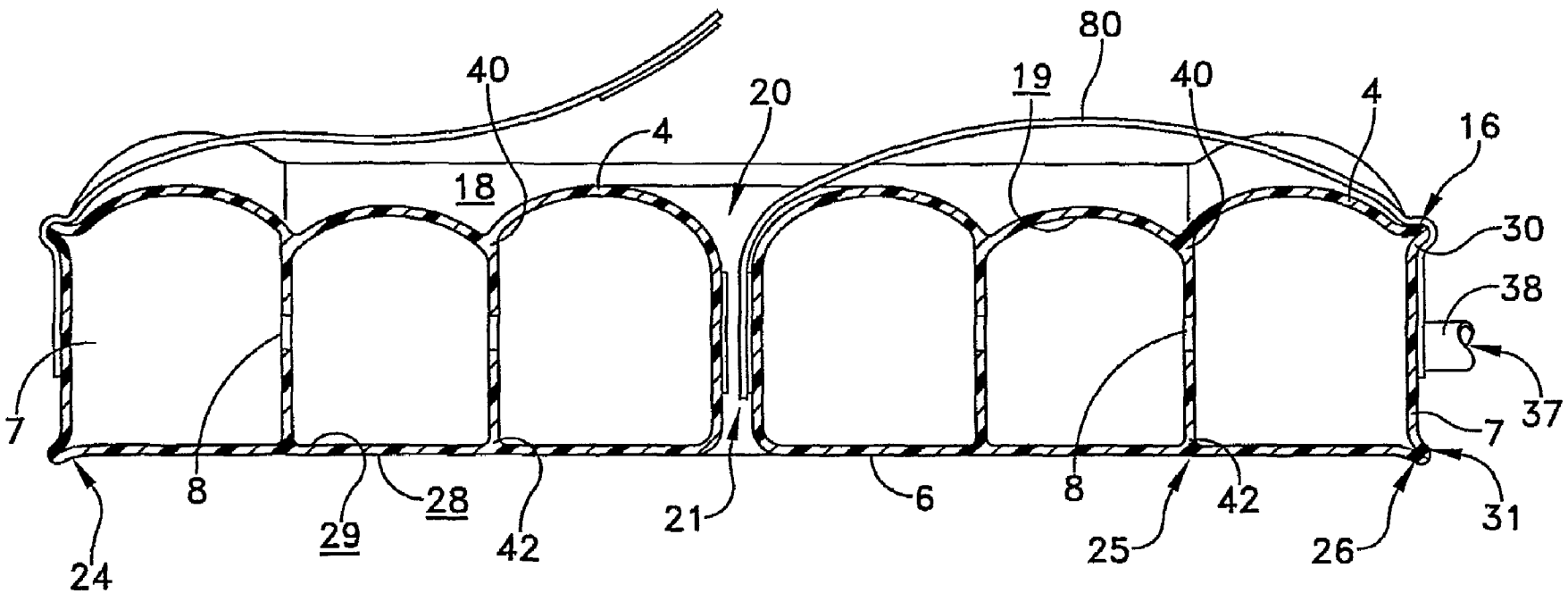
FIG. 3 is a cross-sectional view, taken along line 3-3 in FIG. 2.
Figure 4:
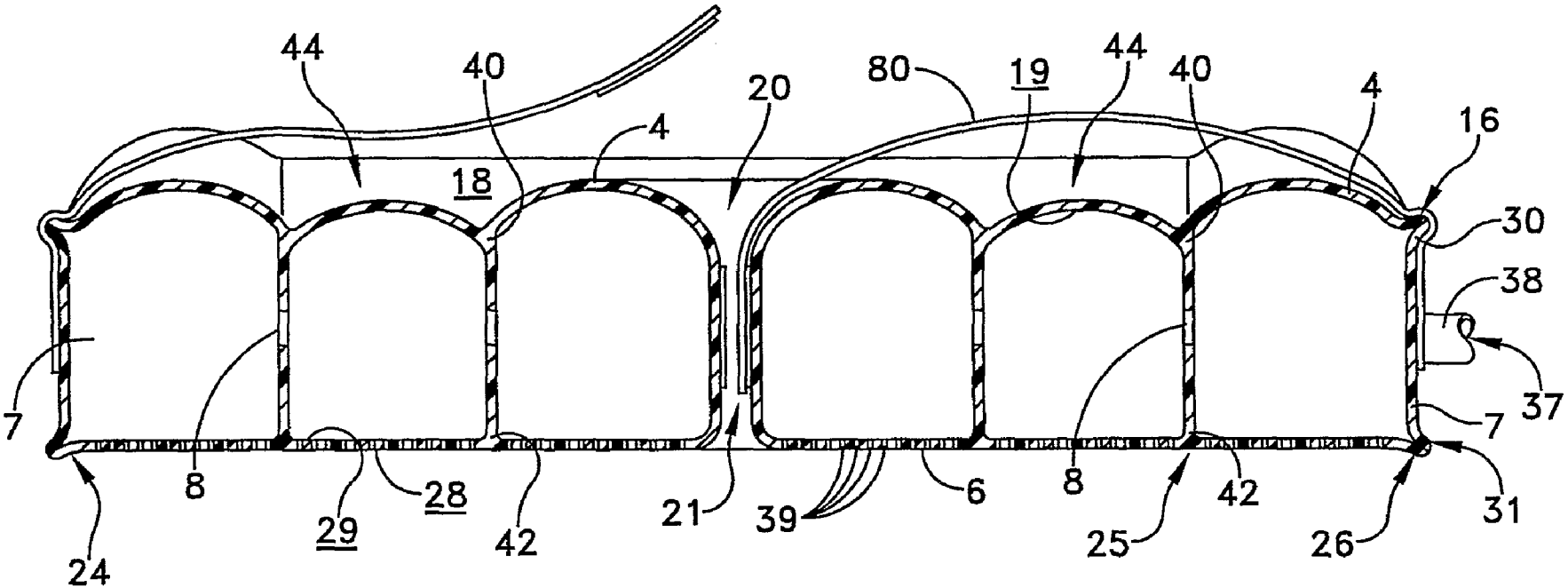
FIG. 4 is a cross-sectional view, similar to FIG. 3, showing an embodiment including a plurality of perforations defined through a bottom panel.
Figure 5:
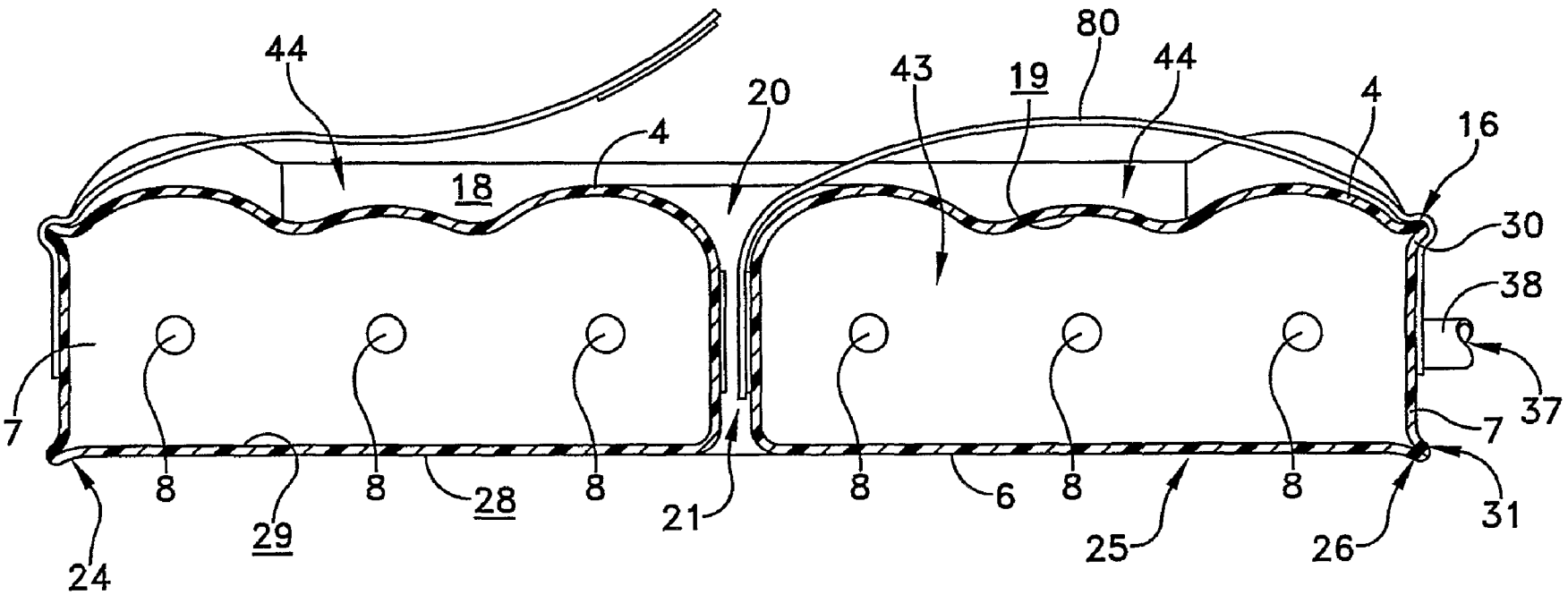
FIG. 5 is a cross-sectional view similar to FIGS. 3 and 4, showing a transversely aligned baffle panel formed in accordance with an alternative embodiment of the present invention.
Figure 6:
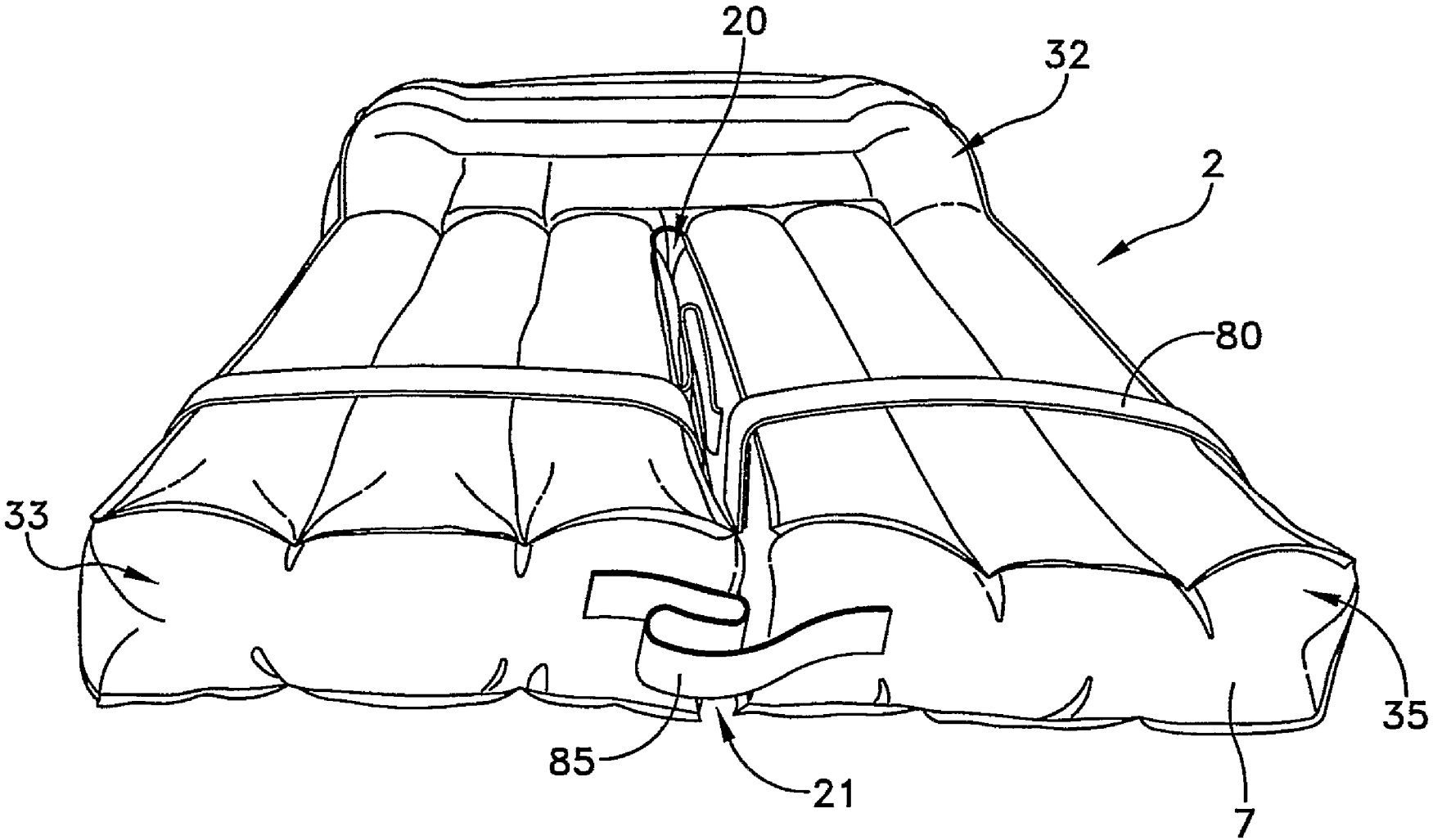
FIG. 6 is an end-on perspective view of the inflatable mattress shown in FIG. 1.

Referring to FIGS. 1-3, the present invention provides an inflatable mattress 2 including a top panel 4, a bottom panel 6, a perimeter band 7, and a plurality of baffle-panels 8. Although often described in the context of providing a toileting or clinical capability, inflatable mattress 2 may be used for a wide variety of patient handling and transfer tasks without deviating from the scope of the invention.

Referring to FIGS. 1-5, top panel 4 comprises a head portion 12, a pair of top appendage panels 14, 15, and a peripheral edge 16, and is formed from a sheet of fabric, e.g., nylon scrim or the like. Top panel 4 is often coated on at least its outer surface 18 with a water proof coating. Inner surface 19 of top panel 4 may also be coated with a water proof coating as well. The water proof coating may be any of the well known polymeric or elastomeric compounds that are known to be impervious to semi-solids and liquids, such as, blood, urine, feces, hospital strength disinfecting compounds, alcohol, or the like. For example, a nylon twill fabric that is coated on one side with a heat sealable, polyurethane coating (e.g., an inner side) and the outer side coated with a Durable Water Repellant (Patient side). A practical benefit associated with the use of the foregoing preferred materials is that inflatable mattress 2 retains a better appearance for longer periods of time during use. Double coated inflatable mattresses 2 can be easily wiped down, and can be put back into use more quickly.

Figure 13:
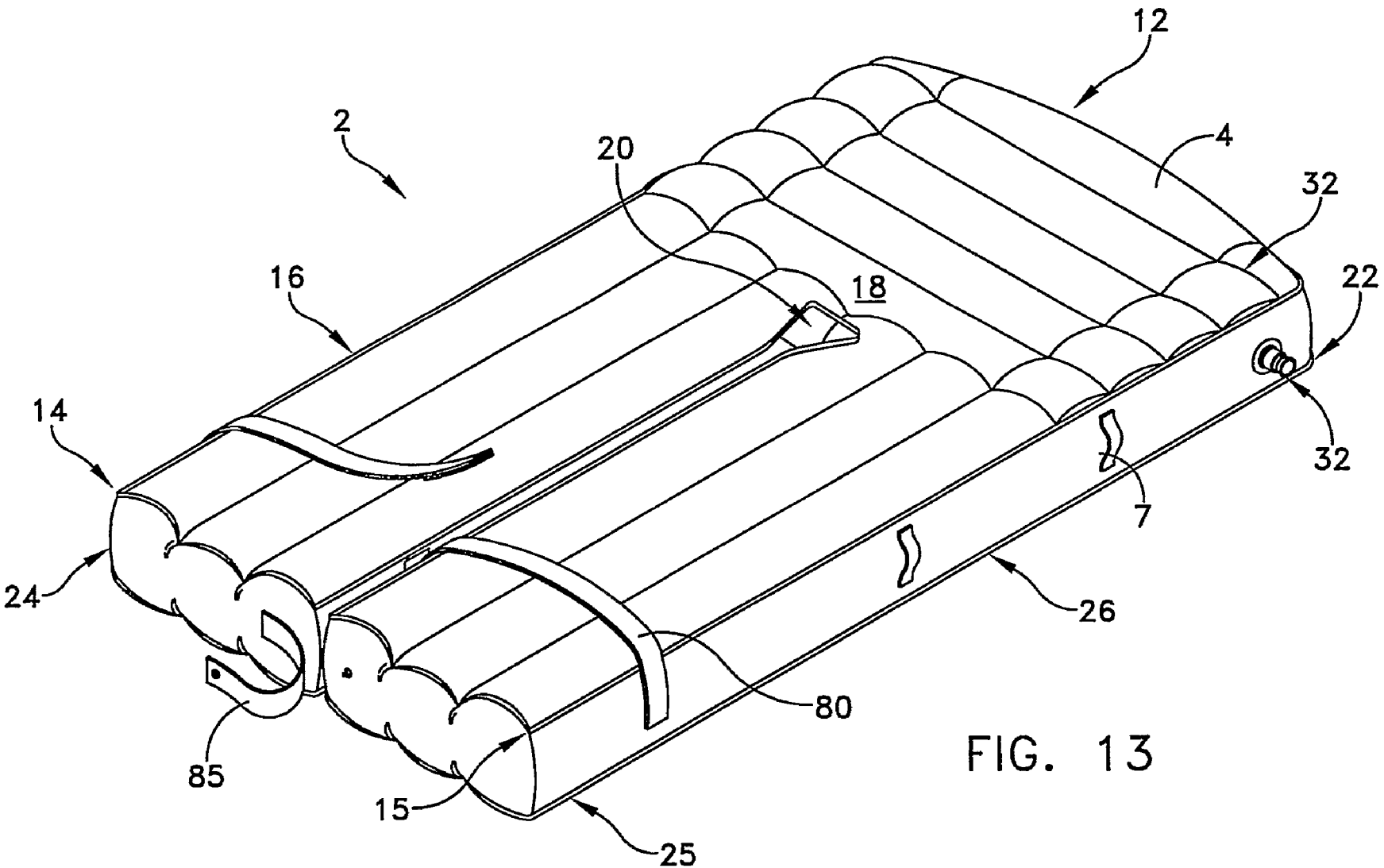
FIG. 13 is yet a further alternative embodiment of inflatable mattress having an alternative frustoconically shaped crotch.
Figure 14:
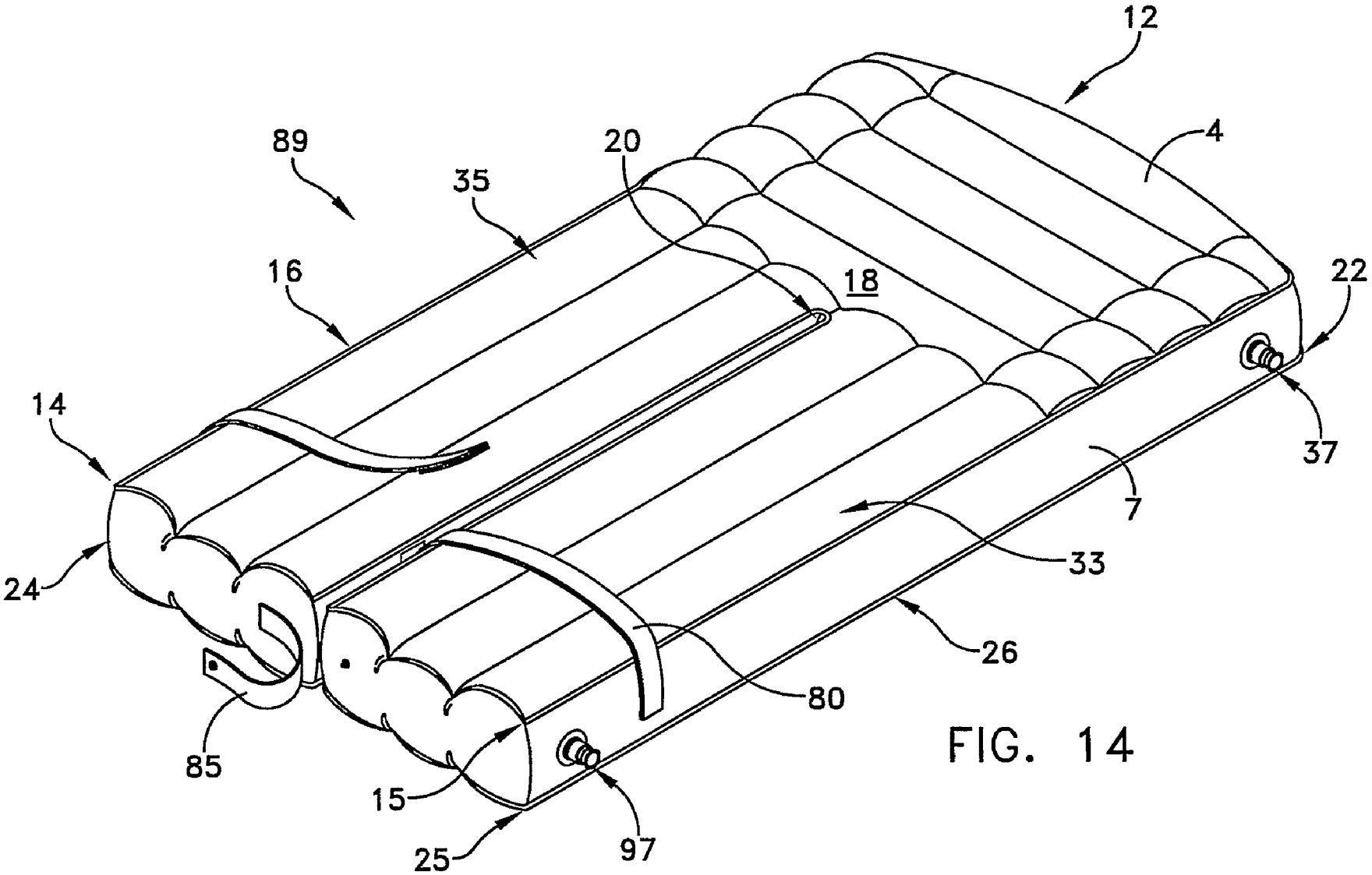
FIG. 14 is a perspective view of an inflatable mattress formed in accordance with another embodiment of the present invention having deflatable legs.
Figure 15:
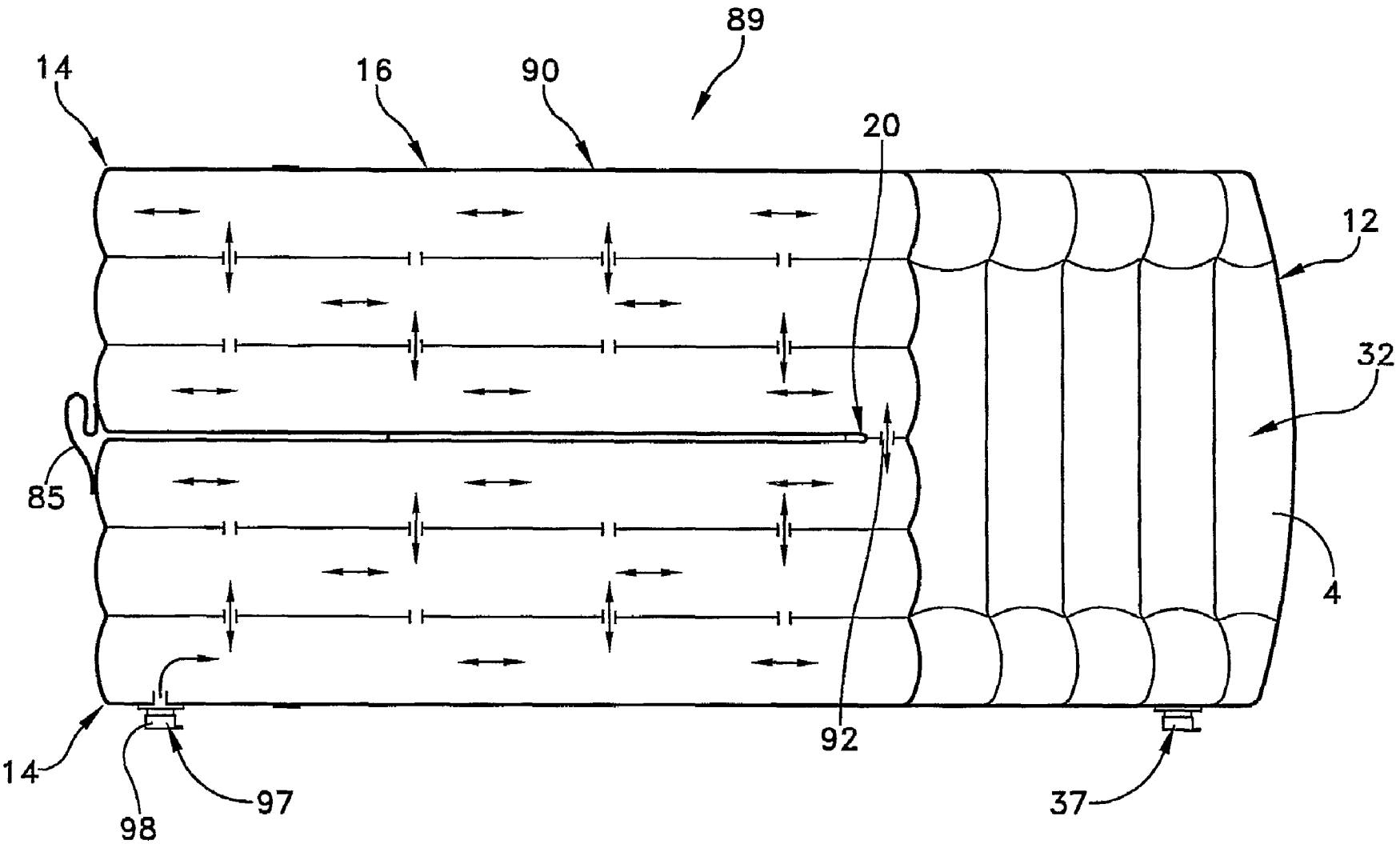
FIG. 15 is a top elevational view of the deflated leg embodiment of inflatable mattress shown in FIG. 14, showing an airflow pattern through a lower portion of the inflatable mattress.

Head portion 12 is sized and shaped so as to extend across a patient's upper torso at least from shoulder to shoulder and from the base of the spine to the top of the head. Peripheral edge 16 defines the perimeter of head portion 12 and each appendage panel 14, 15. Each appendage panel 14, 15 is sized and shaped so as to extend longitudinally outwardly from peripheral edge 16 along the lower portion of head portion 12, i.e., adjacent the base of the patient's spine to beyond the sole of the foot. A crotch 20 is partially defined at a central lower portion of head portion 12, where peripheral edge 16 transitions from a first appendage panel 14 to a second appendage panel 15. A gap 21 is also partially defined between those portions of peripheral edge 16 that confront one another adjacent to appendage panels 14, 15 (FIG. 3). Crotch 20 may define a variety of openings, having a variety of shapes, e.g. oval (FIG. 1), circular (FIGS. 9-12), frustoconical or trapezoidal (FIG. 13), etc., so as to allow for a variety of patient sizes and needs.

Bottom panel 6 is substantially similar in peripheral profile to top panel 4, and comprises a head portion 22, a pair of bottom appendage panels 24,25, and a peripheral edge 26. Bottom panel 6 is also formed from a sheet of nylon scrim or the like, and may be coated on at least its outer surface 28 with a water proof coating. Inner surface 29 of bottom panel 6 may also be coated with a water proof coating as well. Perimeter band 7 often comprises an elongate substantially rectangular strip of nylon scrim or the like, having a top edge 30 and a bottom edge 31 (FIG. 3). Head portion 22 is also sized and shaped so as to extend across a patient's upper torso at least from shoulder to shoulder and from the base of the spine to the top of the head. Each appendage panel 24,25 is sized and shaped so as to extend from the base of the patient's spine to beyond the sole of the foot. Peripheral edge 26 defines the perimeter of head portion 22, and each appendage panel 24,25. Crotch 20 is also partially defined at a central lower portion of head portion 22, where peripheral edge 26 transitions from a first appendage panel 24 to a second appendage panel 25. Gap 21 is also partially defined between those portions of peripheral edge 26 that confront one another adjacent to appendage panels 24,25.

In preferred embodiments of the invention, top panel 4 and bottom panel 6 are substantially the same in size and peripheral outline so that top edge 30 and bottom edge 31 of perimeter band 7 may be sealingly fastened to peripheral edges 16 and 26 of top and bottom panels 4, 6, respectively. That portion of perimeter band 7 that extends between peripheral edges 16 and 26 where those edges transition from a first appendage panel 14 and 24 to a second appendage panel 15 and 25 completes the definition of crotch 20 and gap 21. In this way, a preferred inflatable mattress 2 comprises a torso support pad 32 formed from the joining of head portions 12 and 22, a first leg 33 formed from the joining of top appendage panel 14 and bottom appendage panel 24 and a second leg 35 formed from the joining of top appendage panel 15 and bottom appendage panel 25.

An inlet opening 37 is formed in a portion of perimeter band 7, and may be a closable opening that sealingly accepts an air supply hose 38. Inlet opening 37 is sized and shaped so that air supply hose 38 may be inserted, with the inlet being thereafter snapped shut or otherwise closed to hold air supply hose 38 in place while inflatable mattress 2 is being inflated. Inlet opening 37 may also include a valve (not shown) that is biased to be normally closed to prevent air from exiting through the inlet, and opened when air supply hose 38 is inserted into inlet opening 37. Other arrangements known to those skilled in the art may be used to inflate inflatable mattress 2.

In one alternative embodiment of the invention, bottom panel 6 includes a plurality of tiny holes 39 (FIG. 4) that are defined through its thickness to allow air, that is supplied by a high-pressure air supply to inflatable mattress 2, via air supply hose 38, to escape in a controlled manner so as to allow inflatable mattress 2 to be used as a transfer mattress. The air supplied to a transfer-capable embodiment of inflatable mattress 2 escapes through plurality of holes 39, providing a weight-bearing cushion of air that facilitates the sliding of inflatable mattress 2 along a surface, as well as, from one surface to another.

Plurality of baffle-panels 8 each comprise substantially rectangular sheets of nylon scrim or the like, and include a top edge 40 and a bottom edge 42. Baffle-panels 8 may have differing or varying widths, depending upon their position within inflatable mattress 2. Each top edge 40 may be fastened longitudinally (FIGS. 3 and 4) or transversely (FIG. 5) to a portion of inner surface 19 of top panel 4, and each bottom edge 42 may be fastened longitudinally (FIGS. 3 and 4) or transversely (FIG. 5) to a portion of inner surface 29 of bottom panel 6. When baffle panels 8 are assembled in a transverse manner, they often have a narrow center section 43 that causes at least top panel 4 to form a longitudinally oriented concave recess 44 which helps to cradle a patients legs when inflatable mattress 2 is inflated with air. A similar concave recess 44 is formed when baffle panels 8 are assembled in a longitudinal manner.

An inflatable mattress 2 is assembled according to the present invention in the following manner. Bottom panel 6 is laid out on a suitable support surface so that baffle-panels 8 may be longitudinally or transversely arranged in the center section of inner surface 29 both in head portion 22 and along each appendage panel 24,25. Once in this position, bottom edge 42 of each baffle-panel 8 is fixedly fastened to inner surface 29 of bottom panel 6. Baffle-panels 8 may be heat sealed along the interface between bottom edge 42 and inner surface 29 of bottom panel 6 or sewn in a conventional manner. Heat sealing may be done with the application of heat or ultra sonic energy at the edge interface. In this way, a re-solidified interface structure is formed between bottom edge 42 and inner surface 29 so as to improve the bond and its resistance to rupture under normal loading.

Once plurality of baffle-panels 8 are fastened to inner surface 29 of bottom panel 6, top panel 4 is arranged in overlying confronting relation with bottom panel 6 so that head portion 12 of top panel 4 is confronting head portion 22 of bottom panel 6 and appendage panels 14, 15 of top panel 4 are in confronting relation to appendage panels 24,25 of bottom panel 6. Once in this position, each top edge 40 of each baffle-panel 8 is fixedly fastened to inner surface 19 of top panel 4. One or more perimeter bands 7 are then positioned between peripheral edge 16 of top panel 4 and peripheral edge 26 of bottom panel 6, and then heat sealed along their interface or sewn in a conventional manner. Here again, heat sealing may be done with the application of heat or ultra sonic energy at the interface between peripheral edges 16,26. In this way, a re-solidified interface structure is formed so as to improve the bond and its resistance to rupture under normal loading.

Figure 7:
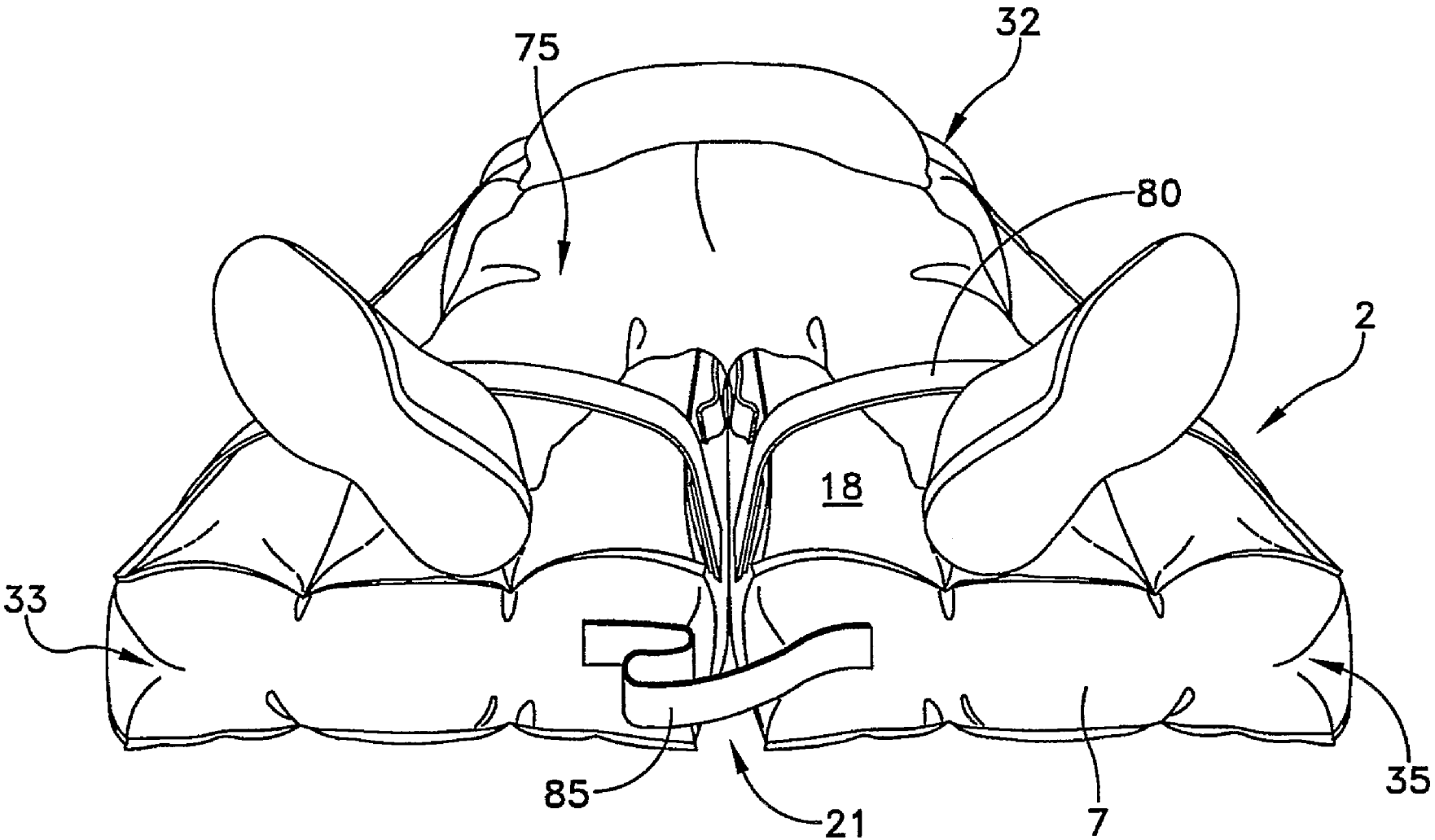
FIG. 7 is an end-on perspective view, similar to FIG. 6, showing a patient positioned on an inflatable mattress.
Figure 8:
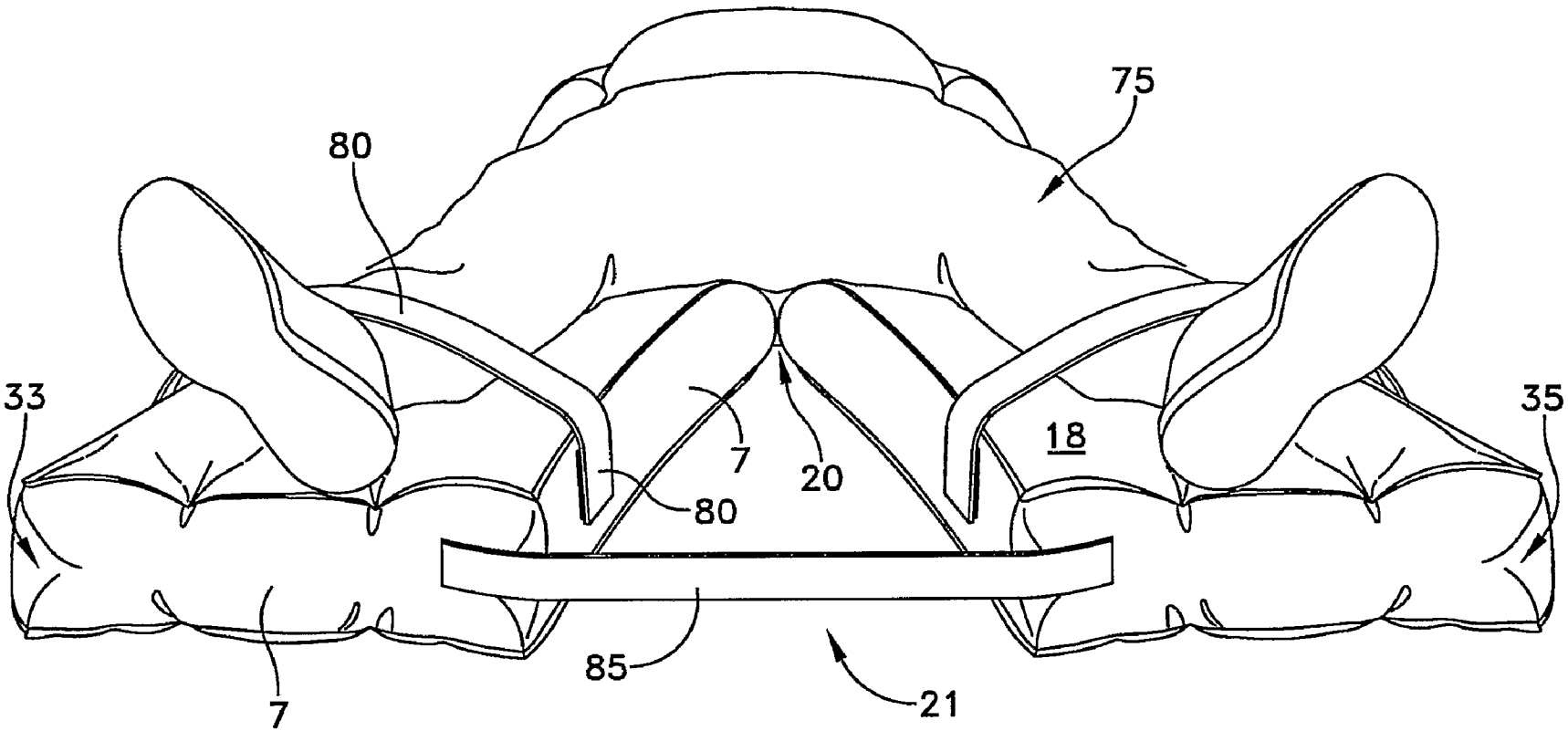
FIG. 8 is an end-on perspective view, similar to FIG. 7, showing a first leg and a second leg spread apart in accordance with one embodiment of the present invention.
Figure 9:
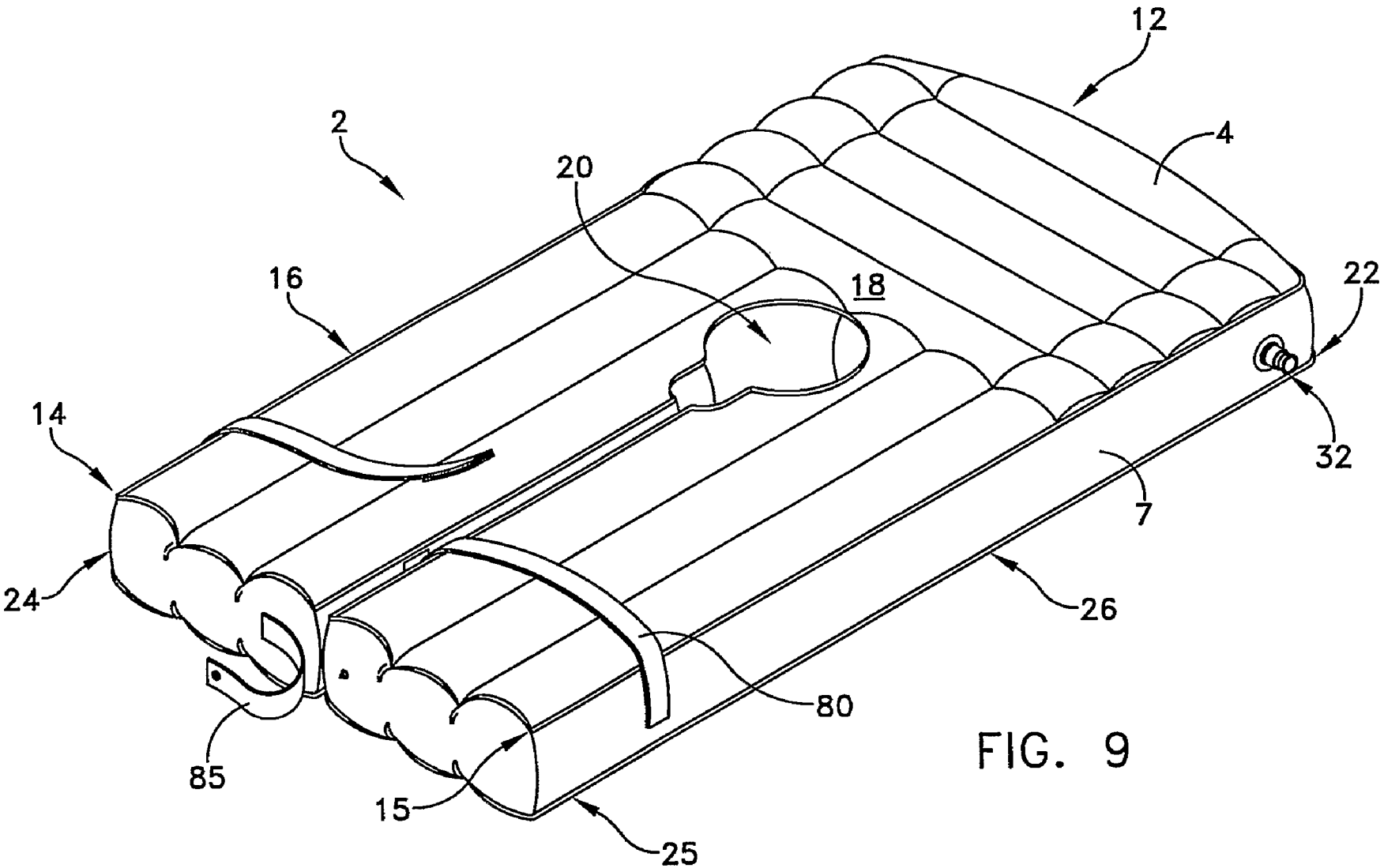
FIG. 9 is a perspective view of the present invention illustrating an alternative crotch and toileting opening.
Figure 10:
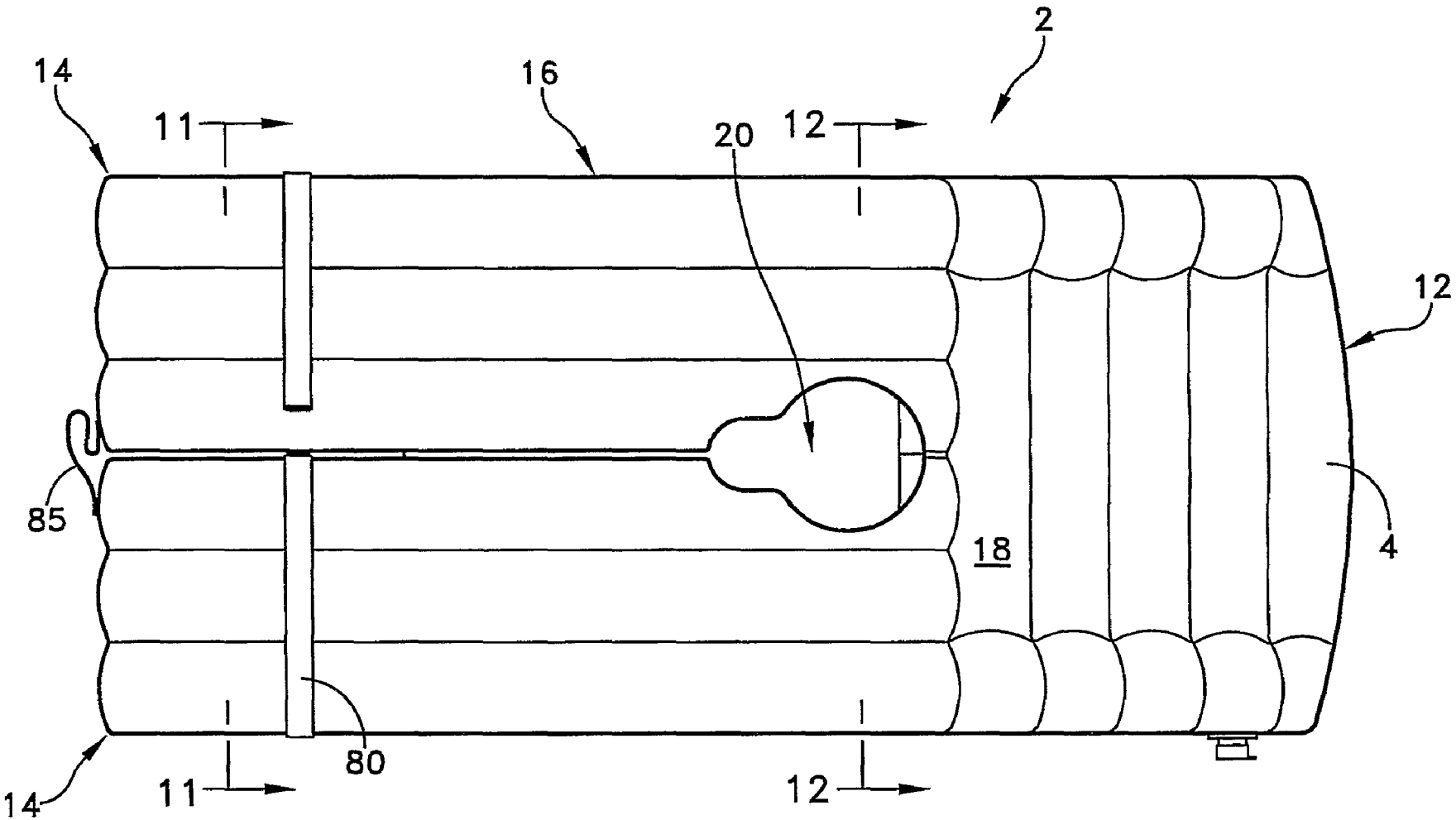
FIG. 10 is a top elevational view of the alternative inflatable mattress shown in FIG. 9.
Figure 11:
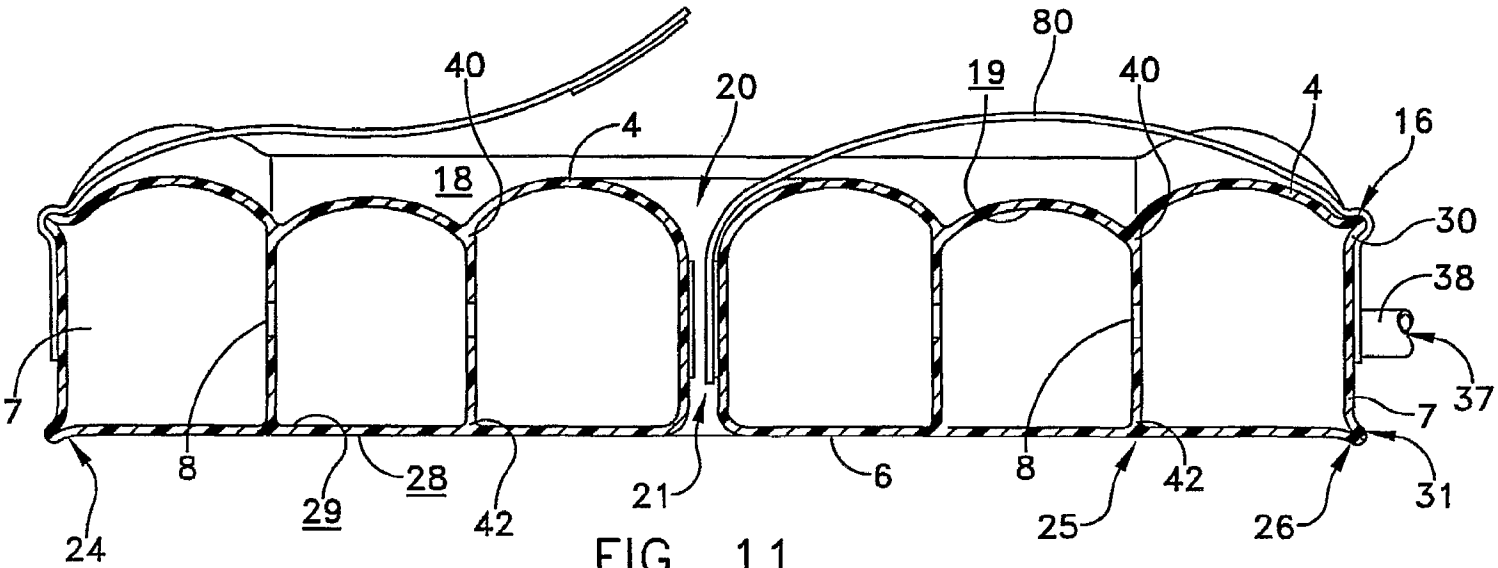
FIG. 11 is a cross-sectional view of the inflatable mattress shown in FIG. 10, as taken along lines 11-11.
Figure 12:
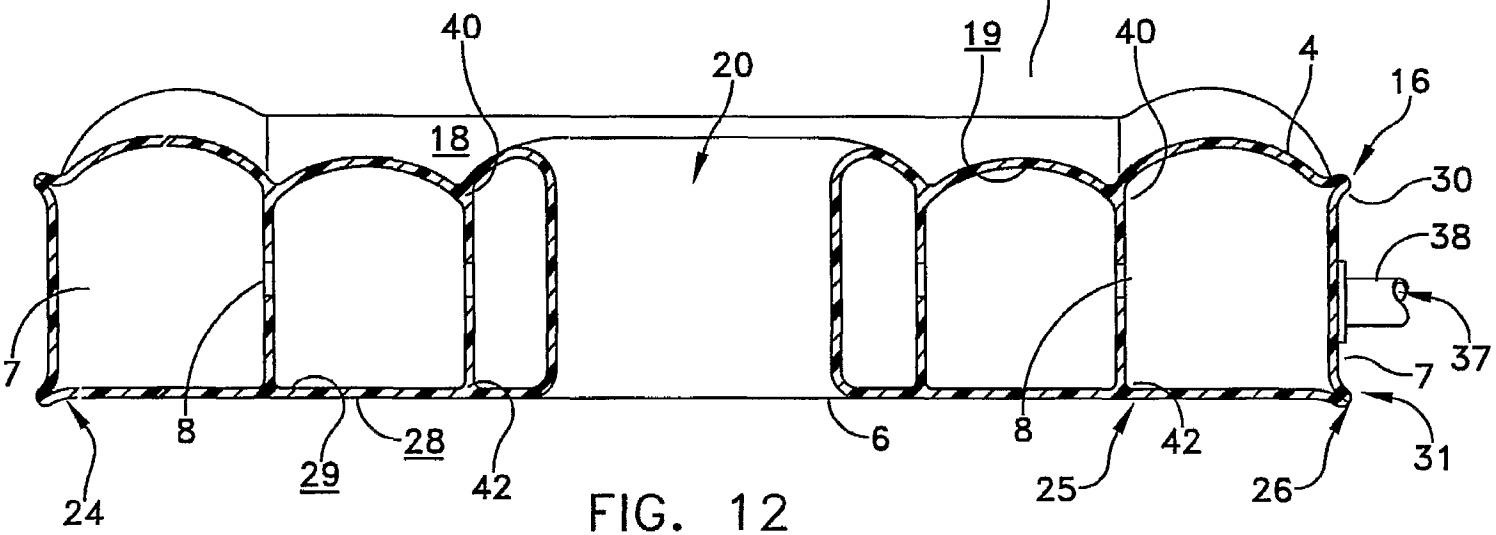
FIG. 12 is a cross-sectional view of the inflatable mattress shown in FIG. 10 as taken along lines 12-12 in FIG. 10.

Inflatable mattress 2 may be used to allow for easy toileting of patients as follows. With air supply hose 38 positioned within opening 37, high-pressure air is forced into inflatable mattress 2 so as to inflate torso support pad 32, first leg 33 and second leg 35. Inflation of inflatable mattress 2 may be accomplished with or without a patient 75 positioned on outer surface 18 of top panel 4 (FIGS. 7 and 8). It is often preferred to have a minimum sized gap 21 defined between first leg 33 and second leg 35. With patient 75 in position upon inflatable mattress 2, and prior to inflation, leg straps 80 may be fastened across outer surface 18 of first leg 33 and second leg 35 of inflatable mattress 2. In this way, patient 75 retains a sense of security while lying upon inflatable mattress 2 during inflation/deflation. A retaining strap 85 also extends across the end surfaces of first leg 33 and second leg 35 so as to limit spreading of legs 33,35. With patient 75 firmly secured to inflatable mattress 2, the patient's legs may be spread so as to provide access to a basin or other toileting apparatus at or below crotch 20, or so as to provide for easy access during clinical procedures. Once the patient has completed their bodily functions, and have been cleaned by an attendant, first leg 33 and second leg 35 are merely moved towards one another so that gap 21 reduces in size until they are adjacent one another. Strap 85 can then be re-secured to maintain inflatable mattress 2 in an arrangement in which the patient's legs are comfortably held together.

Figure 16:
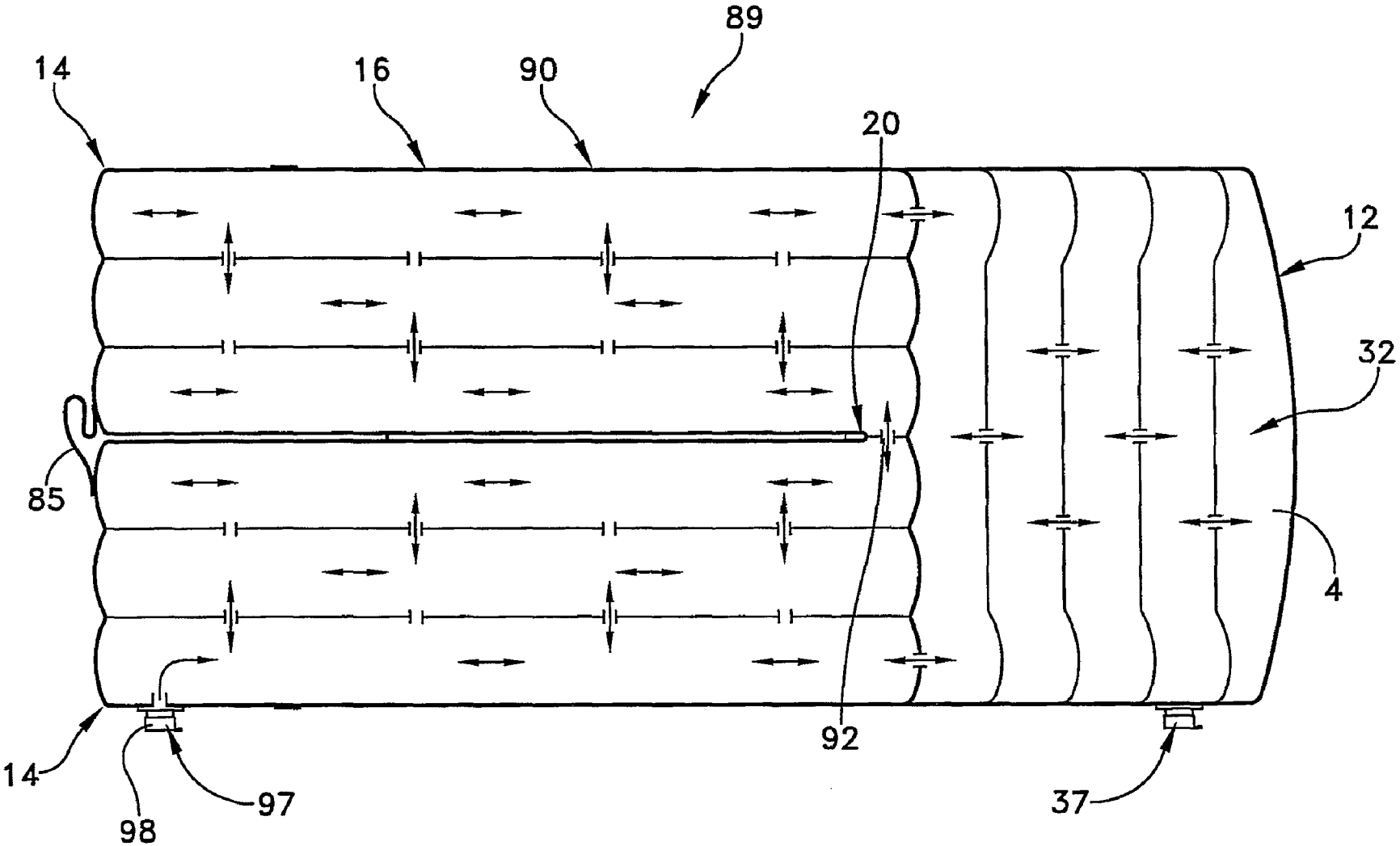
FIG. 16 is a top elevational view of the deflated leg embodiment of inflatable mattress shown in FIG. 14, showing an alternative airflow pattern through the inflatable mattress.
Figure 17:
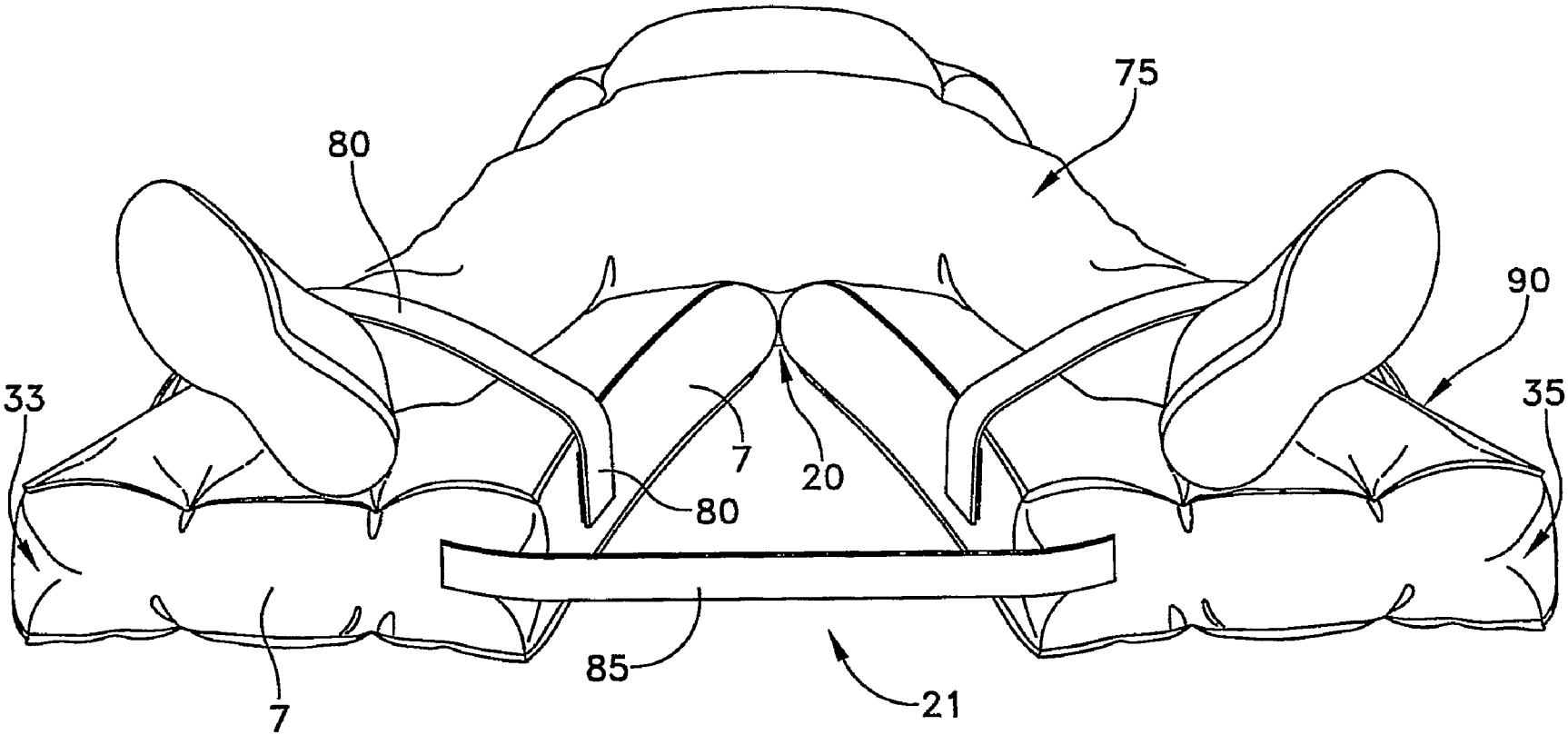
FIG. 17 is an end-on perspective view of the deflating leg inflatable mattress, in an inflated state, with a patient resting upon the mattress.
Figure 18:
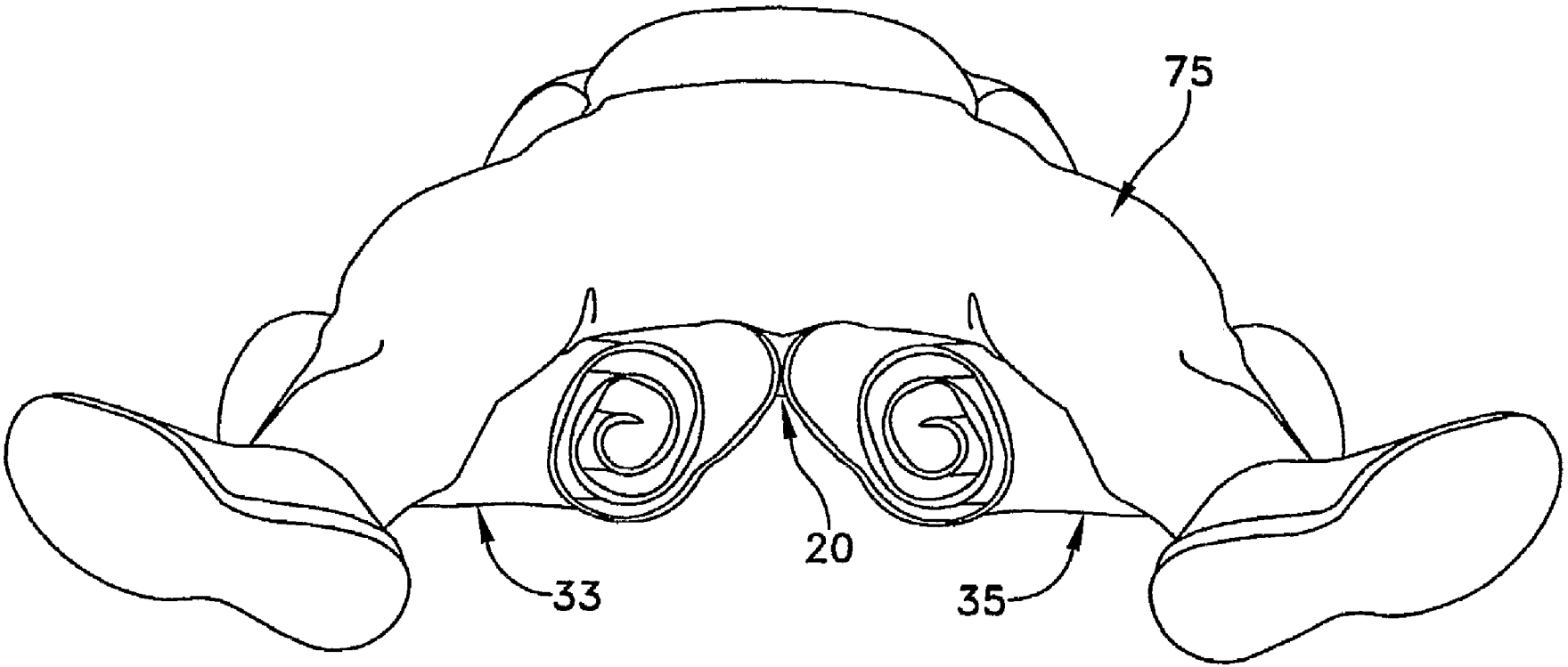
FIG. 18 is an end-on perspective view of the deflating leg inflatable mattress shown in FIG. 17, with the legs of the inflatable mattress deflated and rolled up under the buttocks of the individual in accordance with the present invention.

In an alternative embodiment of the invention, an inflatable mattress 89 includes a first leg 33 and second leg 35 that are formed so as to be a separately inflatable portion 90 from torso support pad 32 (FIGS. 14, 15, 17, and 18). In this way, first leg 33 and second leg 35 are in air flow communication with one another via a connecting passageway 92. A second inlet opening 97 is formed in a portion of perimeter band 7 in either leg 33 or leg 35, and may be a closable opening that sealingly accepts a second air supply hose 98. Inlet opening 97 is sized and shaped so that air supply hose 98 may be inserted, with the inlet being thereafter snapped shut or otherwise closed to hold air supply hose 98 in place while separately inflatable portion 90 is being inflated. Inlet opening 97 may also include a valve (not shown) that is biased to be normally closed to prevent air from exiting through the inlet, and opened when air supply hose 98 is inserted into inlet opening 97. In another embodiment, an inflatable mattress 89 includes a first leg 33 and second leg 35 that are formed so as to be a substantially simultaneously inflatable with torso support pad 32 (FIG. 16). Referring to FIGS. 17 and 18, inflatable mattress 89 is inflated by inserting air supply hose 38 into inlet opening 37 so as to inflate torso support pad 32. Similarly, air supply hose 98 is inserted into inlet opening 97 so as to inflate legs 33,35. The inflation of torso support pad 32 and legs 33,35 may be done in sequence or simultaneously, as desired. Patient 75 may be placed on inflatable mattress 89 before or after inflating has begun or is completed.

Once patient 75 is in this position on a fully inflated inflatable mattress 89, legs 33,35 may be deflated and rolled up away from the patient's legs so that medical or clinical procedures may be performed, e.g., gynecological examination, lower extremity surgery, etc. without having to remove the patient from inflatable mattress 89. Significantly, torso pad 32 may remain inflated during the foregoing process. Once the medical or clinical procedure has been completed, first leg 33 and second leg 35 may be re-inflated, via second inlet opening 97, so as to once again support the patient's legs.

It is to be understood that the present invention is by no means limited only to the particular constructions herein disclosed and shown in the drawings, but also comprises any modifications or equivalents within the scope of the claims.

What is claimed is:

1. An inflatable mattress adapted to support substantially the whole body of a user comprising:

an inflatable torso support pad;

an inflatable first discrete leg extending outwardly and away from the torso support pad; and an inflatable second discrete leg extending outwardly and away from the inflatable torso support pad, wherein the first discrete leg and second discrete leg are movable relative to one another between (i) a first adjacent position, and (ii) a second spaced-apart position, while substantially the whole body of said user continues to be supported by said inflatable mattress, and further wherein said first discrete leg and said second discrete leg are changeable from a substantially fully inflated and supporting state to a substantially deflated and non-supporting state.

2. The inflatable mattress set forth in claim 1 wherein the torso support pad, the discrete first leg, and the discrete second leg communicate with one another so as to be simultaneously pneumatically inflated.

3. The inflatable mattress set forth in claim 2 wherein the torso support pad includes an air inlet valve.

4. The inflatable mattress set forth in claim 1 wherein the first discrete leg and the second discrete leg discretely communicate with said torso support pad so as to be independently pneumatically inflated from the torso support pad.

5. The inflatable mattress set forth in claim 4 wherein the torso support pad includes a first air inlet valve and at least one of the first discrete leg and the second discrete leg include a second air inlet valve.

6. The inflatable mattress set forth in claim 4 wherein the first discrete leg and the discrete second are changeable from a fully inflated state to a substantially deflated state while the torso support pad remains fully inflated so as to substantially support a portion of the body of said user.

7. The inflatable mattress set forth in claim 6 wherein the first discrete leg and the second discrete leg are each deflated and rolled independently upon themselves toward the torso support pad.

8. The inflatable mattress set forth in claim 4 wherein the first leg and second leg pneumatically communicate with one another.

9. The inflatable mattress set forth in claim 8 wherein the torso support pad is pneumatically inflated independent of the first leg and the second leg.

10. A method of positioning a patient for treatment comprising the steps of:

(A) providing an inflatable mattress adapted to support substantially the whole body of a user comprising an inflatable torso support pad, a discreet first leg extending outwardly from a portion of said inflatable torso support pad and a discreet second leg spaced from said first leg and extending outwardly from said portion of said inflatable torso support pad, wherein said first leg and said second leg change from a substantially fully inflated state to a substantially deflated state while substantially the whole body of said user continues to be supported by said inflatable mattress;

(B) positioning the patient upon a selectively inflatable mattress;

(C) inflating a torso support section, a first leg support section, and a second leg support section so as to fully support the patient;

(D) repositioning the selectively inflated mattress;

(E) deflating the first leg support and the second leg support; and (F) rolling the deflated first and second leg supports upon themselves and toward the inflated torso support section.

11. The method according to claim 10 further including the steps of:

(F) unrolling the deflated first and second leg supports so as to be repositioned under the patient's legs; and (G) reinflating the deflated first and second leg supports.

* * * * *